United States Patent [19]

Grace

[11] Patent Number: 4,944,704

[45] Date of Patent: Jul. 31, 1990

[54] TOY-SHAPED MUSICAL NURSER

[76] Inventor: Carol Grace, 32709 S. Lakeshore Dr., Burlington, Wis. 53105

[21] Appl. No.: 291,530

[22] Filed: Dec. 29, 1988

[51] Int. Cl.[5] ..... A63H 3/28; A61J 9/00

[52] U.S. Cl. ..... 446/74; 215/11.1; 446/297

[58] Field of Search ..... 446/71, 72, 73, 74, 446/77, 267, 404, 475, 297, 397, 268; 248/102, 103, 104, 105, 106, 107; 215/11.1, 11.3; 206/457; 84/95.2, 95.1

[56] References Cited

U.S. PATENT DOCUMENTS

| | | | |
|---|---|---|---|
| D 284,408 | 6/1986 | Chan | D24/47 |
| 2,929,290 | 3/1960 | Smith | 84/95 |
| 2,955,382 | 10/1960 | Boles | 215/11.1 X |
| 3,161,311 | 12/1964 | Boston | 215/11.3 |
| 3,627,161 | 12/1971 | Wergelend | 215/11 C |
| 4,678,093 | 7/1987 | Allen | 215/11 R |

FOREIGN PATENT DOCUMENTS

| | | | |
|---|---|---|---|
| 2530461 | 1/1989 | France | 248/102 |

*Primary Examiner*—Mickey Yu

*Attorney, Agent, or Firm*—Philip P. Mann; Michael D. Rechtin

[57] ABSTRACT

A musical nurser includes a bottle portion having a detachable base and a removable nipple opposite the base. A music box is mounted within the detachable base, and a removable cap is provided for enclosing the nipple. The bottle portion, the detachable musical base and the removable cap are each shaped so as to form, when assembled, a unitary structure having a toy-like shape.

6 Claims, 1 Drawing Sheet

TOY-SHAPED MUSICAL NURSER

BACKGROUND OF THE INVENTION

This invention relates generally to baby bottles and, more particularly, to musical baby bottles.

The power of music to soothe and calm temperamental infant children has been used to advantage in a variety of children's products. Stuffed animals, mobiles and dolls have all been manufactured with internal music boxes intended to capture and hold the attention of infants and babies.

The temperamental nature of infant children is frequently noticed during feeding, especially when the infant is fed from a bottle. Accordingly, various attempts have been made to add a music box to a baby bottle or nurser to thereby soothe and calm an infant during feeding. These attempts have typically involved mounting a detachable music box to the base of an otherwise ordinary bottle or nurser. Although this does result in a musical nurser, the nurser nevertheless looks to the infant like an ordinary bottle and thus fails to provide a visual stimulus to further capture and hold the infant's attention.

In view of the foregoing, it is a general object of the present invention to provide a new and improved infant nurser.

It is a further object of the present invention to provide a nurser which captures and holds an infant's attention using both aural and visual stimuli.

It is a still further object of the present invention to provide a musical nurser that can serve as an infant's toy before, during and after feeding.

SUMMARY OF THE INVENTION

The invention provides a musical nurser comprising a bottle portion having an open end adapted to receive thereon a nipple, and having a closed end opposite the open end. The musical nurser further includes a base portion adapted to detachably engage the closed end of the bottle portion. A cap portion is adapted to removably enclose the nipple at the open end of the bottle portion, and a music source is located within the base portion. The bottle portion, the base portion and the cap portion are each shaped so as to form, when assembled, a unitary structure having a predetermined toy-like shape.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Figure 3:
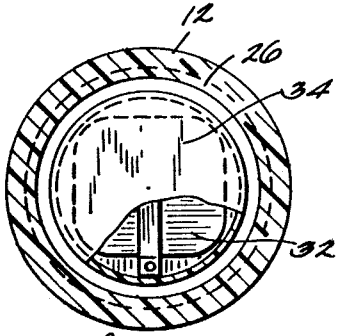
FIG. 3 is a cross-sectional view of the toy-shaped musical nurser shown in FIG. 2 taken along line 3—3 thereof.
Figure 4:
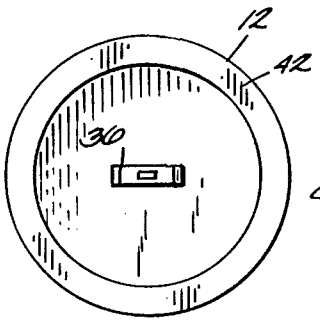
FIG. 4 is a cross-sectional view of the toy-shaped musical nurser shown in FIG. 2 taken along line 4—4 thereof.
Figure 2:
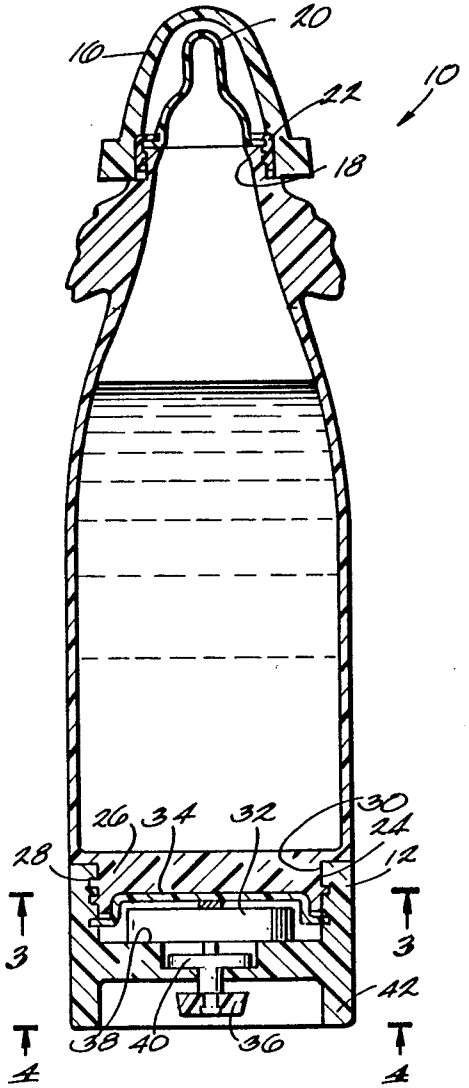
FIG. 2 is a cross-sectional view of the toy-shaped musical nurser.
Figure 1:
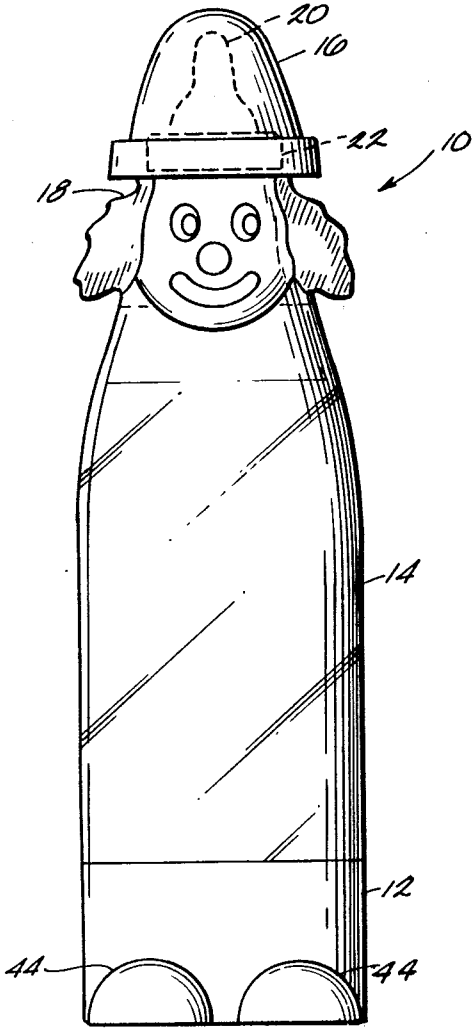
FIG. 1 is a front elevational view of a toy-shaped musical nurser embodying various features of the invention.

Referring to the drawings, a toy-shaped musical nurser embodying various features of the invention is generally designated by reference numeral 10. As illustrated, the musical nurser includes a base portion 12, a bottle portion 14 and a cap portion 16. In accordance with one aspect of the invention, the base portion 12, the bottle portion 14 and the cap portion 16 are each shaped so as to form, when assembled, a unitary structure having a predetermined toy-like shape. In the illustrated embodiment, the shape is that of a clown.

The bottle portion 14 is preferably formed of a clear or translucent, vacuum-formed plastic and includes an open upper end 18 adapted to receive thereon a nipple 20. The nipple 20 is retained in place by means of a threaded retaining collar 22 adapted to engage complimentary threads formed on the open end 18 of the bottle portion 14. Preferably, the nipple 20 and collar 22 are of a standard size, and the open end 18 of the bottle portion 14 is configured for use with commercially available nipples and retaining collars.

Opposite the open end 18, the bottle portion 14 includes a closed lower end 24, and the base portion 12 is adapted to detachably engage the closed end 24. In the illustrated embodiment, the closed lower end 24 includes a downwardly extending cylindrical portion 26 having thereon formed an external thread 28. The base portion 12, which is preferably formed of a molded durable plastic, includes a cylindrical, internally threaded interior recess 30 adapted to engage the complimentary threads 28 formed on the lower end 24 of the bottle portion 14. The exterior of the base portion 12 is shaped so as to blend with the exterior shape of the bottle portion 14 to thereby define the desired toy-like shape.

Within the interior recess 30, the base portion 12 includes a music source which can be selectively actuated by the user. In the illustrated embodiment, the music source comprises a commercially available, wind-up music box 32 dimensioned to fit within the base portion interior recess 30. Preferably, a cover member 34 is provided over the music box 32 so as to prevent the entry of water or other containments.

The music box 32 is wound by means of a downwardly extending, user-accessable, wind-up key 36 which extends through a suitable aperture formed in the bottom wall 38 of the base portion interior recess 30. As illustrated, the key 36 preferably includes an upper flange 40 which prevents downward removal of the key 36 through the aperture. Preferably, the key 36 is formed in two pieces so that, after final assembly, the key cannot be separated from the base portion 12. A downwardly extending outer rim 42 extending around the periphery of the base portion 12, surrounds the key 36 so as to provide clearance for the key 36 when the musical nurser 10 is placed upright on a supporting surface.

The cap portion 16 is also preferably formed of a durable, rigid, molded plastic and is adapted to detachably engage the upper end of the bottle portion 14. In the illustrated embodiment, the cap portion 16 is provided with a hollow interior and the lower end of the cap portion is adapted to be press-fitted onto the nipple retaining collar 22. Alternatively, the cap portion 16 can be arranged to engage the bottle portion 14 itself so that the cap portion 16 can be detachably mounted on the bottle portion 14 without having a nipple 20 and retaining collar 22 in place thereon.

In the illustrated embodiment, the upper end 18 of the bottle portion 14 is molded in the shape of the clown's head, and the cap portion 16 is shaped like a clown's hat. Similarly, the base portion 12 includes a pair of projecting feet 44 which form the clown's feet. Preferably, the threaded engagement of the base portion 12 with the closed end 24 of the bottle portion 14 is such that, when the base portion 12 is fully threaded onto the bottle portion 14, the feet 44 are properly oriented with respect to the clown's face. If desired, the cap portion 16, the bottle portion 14 and the base portion 12 can be painted or colored to further enhance the toy-like appearance of the musical nurser 10.

Because the cap portion 16 and the base portion 12 are detachable from the bottle portion 14, it is possible to use a single cap portion 16 and single base portion 12 in conjunction with a multitude of suitably shaped bottle portions 14 so that several clean bottle portions 14 can be kept on hand for feeding throughout the day. Similarly, a plurality of interchangeable base portions 12, each capable of providing a different musical tune, can be utilized with one or more bottle portions 14. Accordingly, the invention thus provides a flexible nurser system wherein one or more musical base portions can be used in conjunction with a plurality of bottle portions. It will be appreciated that, although the invention has been shown and described in the context of a clown-shaped toy, the invention can also be utilized to provide musical nursers having the shapes of bears, monkeys or other such toys.

While a particular embodiment of the invention has been shown and described, it will be obvious of those skilled in the art that changes and modifications may be made without departing from the invention in its broader aspects, and, therefore, the aim in the appended claims is to cover all such changes and modifications as fall within the true spirit and scope of the invention.

I claim:

1. A musical nurser comprising:

a bottle portion having an open end adapted to receive thereon a nipple and having a closed end opposite said open end;

a base portion detachably mountable on said closed end of said bottle portion, said base portion including a bottom wall having an aperture therethrough;

a cap portion detachably mountable over said nipple at said open end of said bottle portion;

a music source comprising a wind-up music box fully enclosed within said base portion;

user-actuable means comprising a key for actuating said music source, said key extending through said aperture and including an upper flange of greater dimension than said aperture for preventing complete withdrawal of said key through said bottom wall; and said bottle portion, said base portion and said cap portion each being shaped so as to form, when joined to each other, a unitary structure having a predetermined toy-like shape.

2. A musical nurser as defined in claim 1 wherein said base portion threadedly engages said bottle portion.

3. A musical nurser as defined in claim 2 wherein said bottle portion and said base portion are configured so that said base portion is positioned at a predetermined orientation relative to said bottle portion when said base portion is fully engaged with said bottle portion.

4. A musical nurser as defined in claim 1 wherein said music source is located within a recess formed in said base portion and wherein said base portion includes a cover member overlying said music source.

5. A musical nurser as defined in claim 1 wherein said open end of said bottle portion is threaded so as to receive thereon a nipple retaining collar and wherein said cap portion detachably engages said retaining collar.

6. A musical nurser system comprising:

a plurality of bottle portions, each of said bottle portions having the shape of a portion of a predetermined toy-like shape and having an open end adapted to receive thereon a nipple and having a closed end opposite said open end;

a first base portion adapted to detachably engage said closed ends of said plurality of bottle portions said first base portion having the shape of a portion of the predetermined toy-like shape;

a second base portion adapted to detachably engage said closed ends of said plurality of bottle portions, said base portion having the shape of a portion of the predetermined toy-like shape;

a cap portion having the shape of a portion of the predetermined toy-like shape adapted to removably enclose the nipples at said open ends of said bottle portions;

a first music source within said first base portion;

a second music source within said second base position, said second music source being openable to provide a different musical tune from said first music source; and said first and second base portions, said cap portion and each of said bottle portions being shaped so as to form a unitary structure having the predetermined toy-like shape when said cap portion and one of said bottle portions are assembled with one of said first and second base portions.

* * * * *

UNITED STATES PATENT AND TRADEMARK OFFICE

CERTIFICATE OF CORRECTION

PATENT NO. : 4,944,704

DATED : July 31, 1990

INVENTOR(S) : Grace, Carol

It is certified that error appears in the above-identified patent and that said Letters Patent is hereby corrected as shown below:

Column 4:

In Claim 6, lines 46 and 47, "position" should be --portion--.

In Claim 6, line 47, "openable" should be --operable--.

Signed and Sealed this

Twenty-first Day of July, 1992

*Attest:*

DOUGLAS B. COMER

*Attesting Officer*

*Acting Commissioner of Patents and Trademarks*